US012534895B1

(12) United States Patent
Yang et al.

(10) Patent No.: US 12,534,895 B1
(45) Date of Patent: Jan. 27, 2026

(54) DRUM DREDGING MACHINE FOR PREVENTING TANGLING

(71) Applicant: ZHEJIANG JIAHONG TOOLS MANUFACTURE CO., LTD, Lishui (CN)

(72) Inventors: Jianxin Yang, Lishui (CN); Defu Ben, Lishui (CN); Zhe Fang, Lishui (CN); Lei Zhang, Lishui (CN)

(73) Assignee: ZHEJIANG JIAHONG TOOLS MANUFACTURE CO., LTD, Lishui (CN)

( * ) Notice: Subject to any disclaimer, the term of this patent is extended or adjusted under 35 U.S.C. 154(b) by 0 days.

(21) Appl. No.: 19/310,928

(22) Filed: Aug. 27, 2025

(30) Foreign Application Priority Data

| | | |
|---|---|---|
| Apr. 16, 2025 | (CN) | 202510479191.2 |
| Apr. 16, 2025 | (CN) | 202520721947.5 |
| May 17, 2025 | (CN) | 202520972109.5 |
| Jul. 15, 2025 | (CN) | 202510970360.2 |

(51) Int. Cl.
*E03C 1/302* (2006.01)

(52) U.S. Cl.
CPC ..... *E03C 1/302* (2013.01)

(58) Field of Classification Search
CPC ..... E03F 9/00; B65H 75/34; B65H 2701/33; B65H 75/4471; B65H 51/10; B65H 75/364; B65H 75/40; B65H 75/42; B08B 9/045
USPC ..... 15/104.33
See application file for complete search history.

(56) References Cited

U.S. PATENT DOCUMENTS 10,626,593 B2 * 4/2020 Puzio ..... B08B 9/0436

* cited by examiner

*Primary Examiner* — Katina N. Henson
(74) *Attorney, Agent, or Firm* — Birchwood IP

(57) ABSTRACT

A drum dredging machine for preventing tangling is provided. Which includes a flexible shaft box; a guide tube provided inside the flexible shaft box; a fixing sleeve fixed at one axial end of the flexible shaft box; an inner lining fixed at an another axial end of the flexible shaft box; a rotatable sleeve rotatably provided between the fixing sleeve and the inner lining. The rotatable sleeve is provided with a guide groove. The guide tube is placed in the guide groove to cause the guide tube to be in contact with the rotatable sleeve; the fixing sleeve, inner lining, and rotatable sleeve are coaxially arranged, and an annular outer wall formed by the three together forms an annular chamber with an inner wall of the flexible shaft box. The present disclosure has advantages of avoiding tangling of the flexible shaft inside the flexible shaft box.

13 Claims, 18 Drawing Sheets

DRUM DREDGING MACHINE FOR PREVENTING TANGLING

CROSS-REFERENCE TO RELATED APPLICATIONS

This application claims priority to Chinese Patent Application No. 202510479191.2, filed on Apr. 16, 2025, Chinese Patent Application No. 202520721947.5, filed on Apr. 16, 2025, Chinese Patent Application No. 202520972109.5, filed on May 17, 2025, Chinese Patent Application No. 202510970360.2, filed on Jul. 15, 2025. All of which are hereby incorporated by reference in their entireties.

TECHNICAL FIELD

The present disclosure relates to the field of dredging machine technologies, and in particular, to a drum dredging machine for preventing tangling.

BACKGROUND

Drum type dredging machine belongs to a specialized tool for pipeline cleaning. Currently, drum type dredging machines are mainly designed with components such as a bracket, a motor, a belt, a flexible shaft box, a flexible shaft, and an inner lining. The motor drives the flexible shaft box and the flexible shaft to rotate and transport back and forth by driving the belt on the flexible shaft box to rotate. The flexible shaft box has a guide tube inside, which synchronously drives the guide tube to rotate when the flexible shaft box is rotated. The guide tube has functions of making the flexible shaft move forward and backward horizontally, thus achieving the cleaning work of a pipeline by the flexible shaft. Due to the winding state of the flexible shaft in the flexible shaft box, there is often a problem of tangling of the flexible shaft inside the flexible shaft box.

SUMMARY

To address the shortcomings of existing technology, a drum dredging machine is provided that avoids tangling of the flexible shaft inside the flexible shaft box.

The present disclosure is implemented using the following technical solution.

A drum dredging machine for preventing tangling, including:

a flexible shaft box, an interior of the flexible shaft box is hollow, and a flexible shaft is wrapped and stored inside the flexible shaft box;

a guide tube, which is provided inside the flexible shaft box and is rotatably connected to the flexible shaft box; the guide tube is arc-shaped, and one end of the guide tube is extended to an outer side of the flexible shaft box, the guide tube is hollow, and the flexible shaft is inserted and exited through the guide tube;

a fixing sleeve, which is fixedly provided at an axial end of the flexible shaft box, the fixing sleeve is hollow and is configured for the guide tube to be extended outside the flexible shaft box;

an inner lining, which is fixedly provided at another axial end of the flexible shaft box;

a rotatable sleeve, which is rotatably provided between the fixing sleeve and the inner lining, and the rotatable sleeve is connected to an axis side of the inner lining; the rotatable sleeve is provided with a guide groove that matches a shape of the guide tube, and the guide tube is placed in the guide groove to cause the guide tube to be in contact with the rotatable sleeve;

where the fixing sleeve, the inner lining, and the rotatable sleeve are coaxially arranged, and the three define an axial space inside the flexible shaft box, so that an annular outer wall formed by the three together forms an annular chamber with an inner wall of the flexible shaft box, where the annular chamber is configured for the flexible shaft to be wound and stored.

During the operation of the drum dredging machine, the flexible shaft box is rotated according to its conventional driving method (such as being driven by a motor through a belt). This rotational motion drives the flexible shaft to be wrapped inside the flexible shaft box to rotate around its own axis, and also drives an arc-shaped guide tube linked with it to rotate synchronously. The flexible shaft is extended or retracted inside the guide tube.

The effect of the present disclosure lies in a winding-and-storing process of the flexible shaft: by coaxially arranging the fixing sleeve, the inner lining, and the rotatable sleeve, and tightly filling an axial space inside the flexible shaft box, these three together construct a complete, continuous, and uninterrupted annular chamber between the inner wall of the flexible shaft box and its respective outer walls. This annular chamber is specifically designed for the winding and storage of the flexible shaft. When the flexible shaft is retracted for storage and wrapping, it is completely confined within this continuous annular chamber. Due to the elimination of harmful gaps or unexpected clearance spaces between the annular chamber wall (i.e. outer walls of the fixing sleeve, inner lining, and rotatable sleeve) and the inner wall of the flexible shaft box, the flexible shaft cannot enter an unconstrained area that was previously prone to tangling during the winding process. Therefore, it effectively prevents a problem of disorderly twisting or tangling of the flexible shaft during winding and storage, thereby significantly improving the reliability of equipment operation.

In some embodiments of the present disclosure, circumferential outer walls of the fixing sleeve, the inner lining, and the rotatable sleeve are aligned in an axial direction.

Through the above settings, projections of the circumferential outer walls of the fixing sleeve, the inner lining, and the rotatable sleeve in the axial direction are coincided, thereby further ensuring the integrity and continuity of the annular chamber between the three and the inner wall of the flexible shaft box.

In some embodiments of the present disclosure, an inner side end of the guide tube is located at an opening of the guide groove and is flushed with the circumferential outer wall of the rotatable sleeve; or the inner side end of the guide tube is located inside the guide groove.

By the above settings, the guide tube will not be exposed at the opening of the guide groove, thereby ensuring the integrity of the annular chamber and further reducing the possibility of tangling of the flexible shaft during winding.

In some embodiments of the present disclosure, the drum dredging machine further includes a bracket and a fixing shaft fixedly provided on the bracket, the fixing shaft passes through axis of the flexible shaft box and the inner lining, the flexible shaft box and the inner lining are rotatably fixed on the fixing shaft;

the rotatable sleeve includes an extension portion that is outwardly protruded towards the inner lining, the extension portion is sleeved on the fixing shaft and connected to the fixing shaft through a first bearing, thereby enabling the rotatable sleeve to be rotatably provided between the fixing sleeve and the inner lining.

Through the above settings, the rotatable sleeve is designed to be separated separately, so that the rotatable sleeve can rotate independently. The rotatable sleeve is rotatably connected to the fixing shaft through the first bearing, which has less resistance during rotation. At the same time, the rotatable sleeve is driven by the guide tube to rotate without direct contact with the fixing sleeve, and the rotation will not be stuck, rendering the rotation easier. It simulates the rotation state of the guide tube and the flexible shaft so as to maintain synchronous rotation with the flexible shaft and further avoid a problem of tangling when the flexible shaft is wrapped and stored.

In some embodiments of the present disclosure, one end of the inner lining facing the rotatable sleeve is inwardly recessed to form a recess, and the recess corresponds to a shape of the extension portion of the rotatable sleeve, the inner lining is provided with a shaft hole that is penetrated axially, the shaft hole passes through a center of the recess, and the fixing shaft passes through the shaft hole.

The above settings can make the rotatable sleeve and inner lining closer together, which results in a more compact structure.

In some embodiments of the present disclosure, the drum dredging machine further includes a bracket and a fixing shaft fixedly provided on the bracket, the fixing shaft passes through axis of the flexible shaft box and the inner lining; the flexible shaft box and the inner lining are rotatably fixed on the fixing shaft;

the inner lining includes a protruding portion facing the rotatable sleeve, the protruding portion is provided with a second bearing, and the rotatable sleeve is sleeved on the second bearing; so that the rotatable sleeve is rotatably connected to the protruding portion of the inner lining, thereby enabling the rotatable sleeve to be rotatably provided between the fixing sleeve and the inner lining.

Through the above settings, the rotatable sleeve is designed to be separated separately, so that the rotatable sleeve can rotate independently. The rotatable sleeve is rotatably connected to the protruding portion through the second bearing, which has less resistance during rotation. At the same time, the rotatable sleeve is driven by the guide tube to rotate without direct contact with the fixing sleeve, so that the rotation will not be stuck and the rotation will be easier. This simulates the rotation state of the guide tube and the flexible shaft so as to maintain synchronous rotation with the flexible shaft and further avoid the problem of tangling when the flexible shaft is wrapped and stored.

In some embodiments of the present disclosure, a hollow end cap is fixedly provided on the fixing sleeve, and the guide tube passes through the fixing sleeve and the end cap; the end cap is axially connected to the guide tube through a third bearing, thereby enabling a rotational connection between the guide tube and the flexible shaft box.

The fixing sleeve is fixed to the flexible shaft box, and the end cap is sleeved on the fixing sleeve. The third bearing is provided on the end cap, and the end cap is rotatably connected to the guide tube through the third bearing on the end cap, thereby ultimately achieving the rotational connection between the guide tube and the flexible shaft box.

In some embodiments of the present disclosure, the end cap is fixedly provided on an outer side of the flexible shaft box, the end cap is coaxially arranged with the fixing sleeve, a wall of an end face of the flexible shaft box is located between the end cap and the fixing sleeve; the end cap, the wall of the end face of the flexible shaft box, and the fixing sleeve are all provided with screw holes; the end cap, the flexible shaft box and the fixing sleeved are fixed together by a bolt passing through the screw holes.

In some embodiments of the present disclosure, the end cap is a conical structure with upper and lower flat tops, and an interior of the end cap is hollow.

In some embodiments of the present disclosure, a fixing ring is fixedly sleeved on an outer side end of the guide tube, and the fixing ring is located on an outer side of the end cap of the guide tube; the bolt or a fixing pin passes through the fixing ring and the wall of the guide tube, and compresses the flexible shaft in the guide tube.

The above settings can avoid excessive jumping of the flexible shaft when extending or retracting, thereby ensuring the stability of the flexible shaft when entering and in exiting the guide tube.

In some embodiments of the present disclosure, an axial wall of the flexible shaft box is provided with a plurality of hollow holes that are penetrated inside and outside.

By providing the hollow holes, a user can easily observe the interior of the flexible shaft box.

In some embodiments of the present disclosure, the inner lining includes a fixing disk provided at an end of the inner lining, the inner lining is fixedly connected or integrally formed with the fixing disk; an outer diameter of the fixing disk is larger than an outer diameter of the inner lining; the fixing disk is located on an outer side of the flexible shaft box and fixed to the axial end face of the flexible shaft box by the bolt.

By providing the fixing disc, the inner lining and the flexible shaft box are fixed.

In some embodiments of the present disclosure, an interior of the inner lining includes internal fixing plate structures.

The internal fixing plate structures are divergent, thereby creating a cavity between adjacent internal fixing plates. The internal fixing plates not only ensure the strength of the inner lining, but also reduce the weight of the entire inner lining.

Compared with existing technologies, the beneficial effects of the present disclosure are: 1. by coaxially arranging the fixing sleeve, inner lining, and rotatable sleeve, and tightly filling an axial space inside the flexible shaft box, these three together construct a complete, continuous, and uninterrupted annular chamber between the inner wall of the flexible shaft box and its respective outer walls. This annular chamber is specifically designed for the winding and storage of the flexible shaft. When the flexible shaft is retracted for storage and wrapping, it is completely confined within this continuous annular chamber. Due to the elimination of harmful gaps or unexpected clearance spaces between the annular chamber wall (i.e. the outer walls of the fixing sleeve, inner lining, and rotatable sleeve) and the inner wall of the flexible shaft box, the flexible shaft cannot enter an unconstrained area that was previously prone to tangling during the winding process. Therefore, it effectively prevents the problem of disorderly twisting or tangling of the flexible shaft during winding and storage, thereby significantly improving the reliability of equipment operation.

2. The rotatable sleeve is designed to be separated separately, so that the rotatable sleeve can rotate independently. The rotatable sleeve is rotatably connected to the fixing shaft or protruding portion through the bearing, which has less resistance during rotation. At the same time, the rotatable sleeve is driven by the guide tube to rotate without direct contact with the fixing sleeve, and the rotation will not be stuck, rendering the rotation easier. It simulates the rotation state of the guide tube and the flexible shaft so as to maintain synchronous rotation with the flexible shaft and further avoid the problem of tangling when the flexible shaft is wrapped and stored.

Numeral reference: 1—guide tube; 2—end cap; 21—curved surface; 3—fixing sleeve; 4—rotatable sleeve; 41—guide groove; 42—extension portion; 5—inner lining; 51—protruding portion; 52—internal fixing plate; 53—shaft hole; 6—fixing disk; 61—disk claw; 7—flexible shaft box; 71—hollow hole; 8—flexible shaft; 91—first bearing; 92—second bearing; 93—third bearing; 94—fourth bearing; 10—motor; 101—belt; 11—bracket; 111—locking pin; 112—locking hole; 12—fixing shaft; 13—fixing ring; 131—fixing pin; 14—annular chamber; 15—annular outer wall; 16—bolt.

DESCRIPTION OF EMBODIMENTS

The present disclosure will be further described based on the accompanying drawings and specific embodiments.

Figure 1:
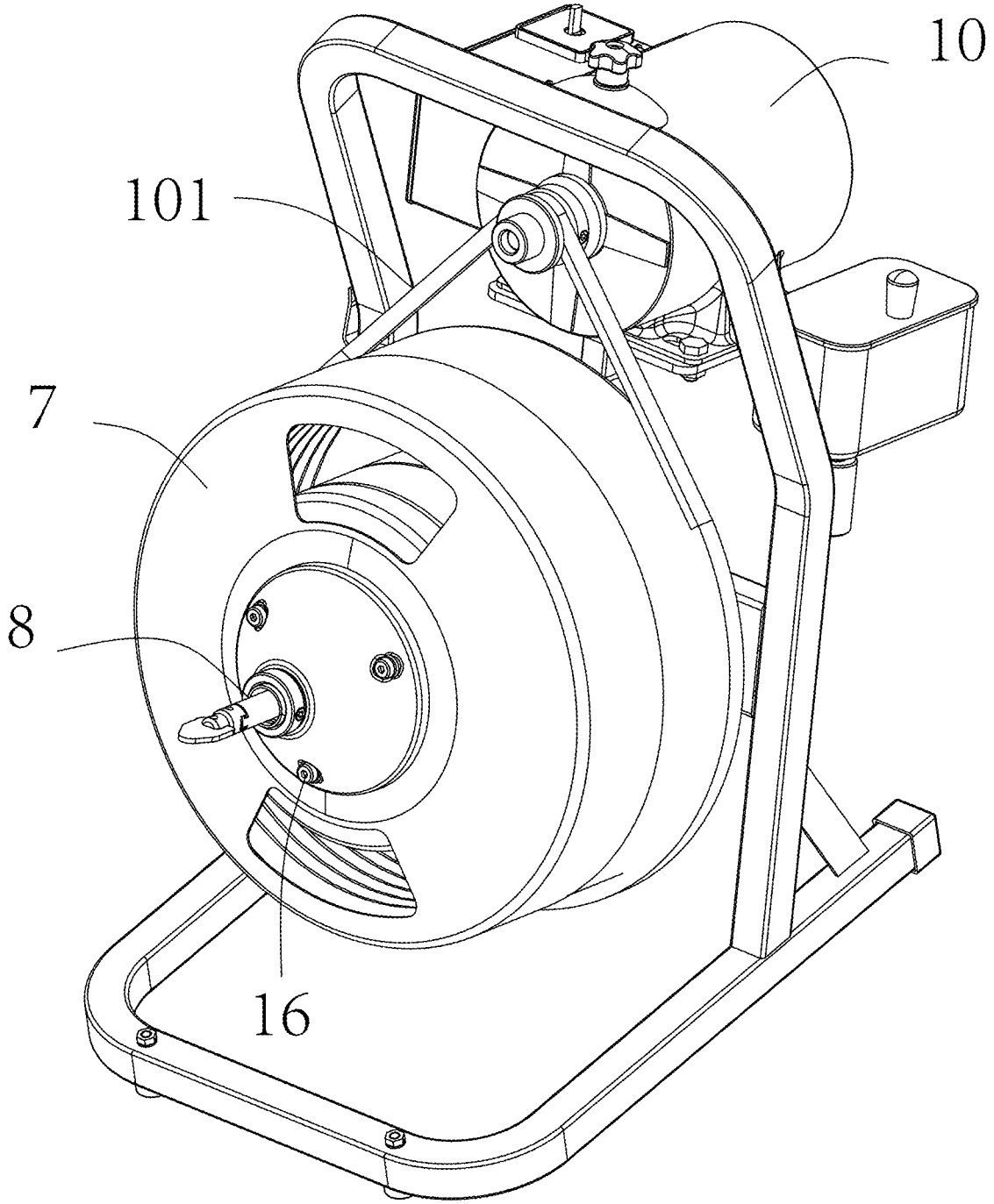
FIG. 1 is a schematic diagram of a drum dredging machine.
Figure 2:
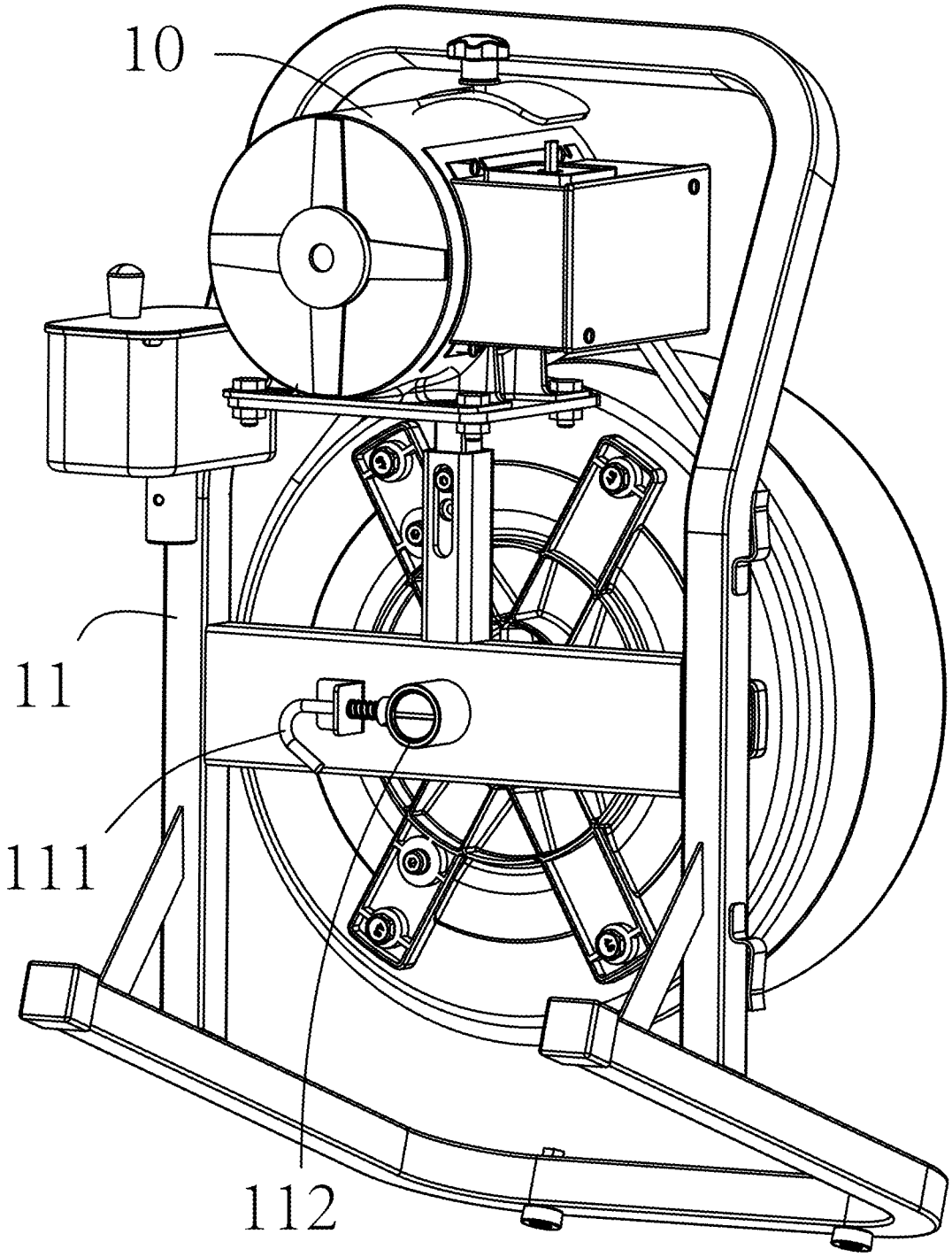
FIG. 2 is a schematic diagram of the drum dredging machine from another angle.
Figure 3:
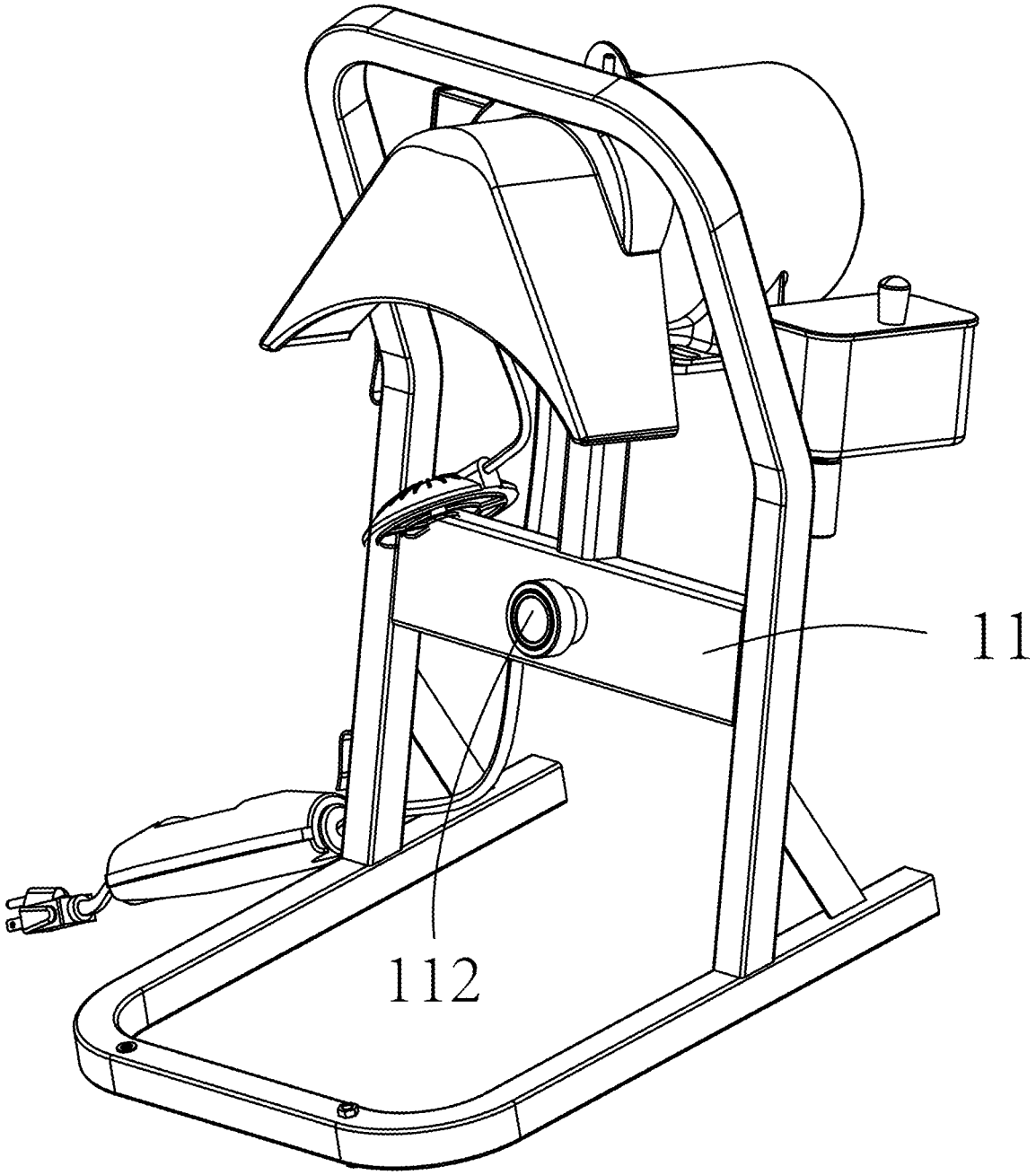
FIG. 3 is a schematic structural diagram of a bracket and a motor of the drum dredging machine, with rotating parts removed.
Figure 4:
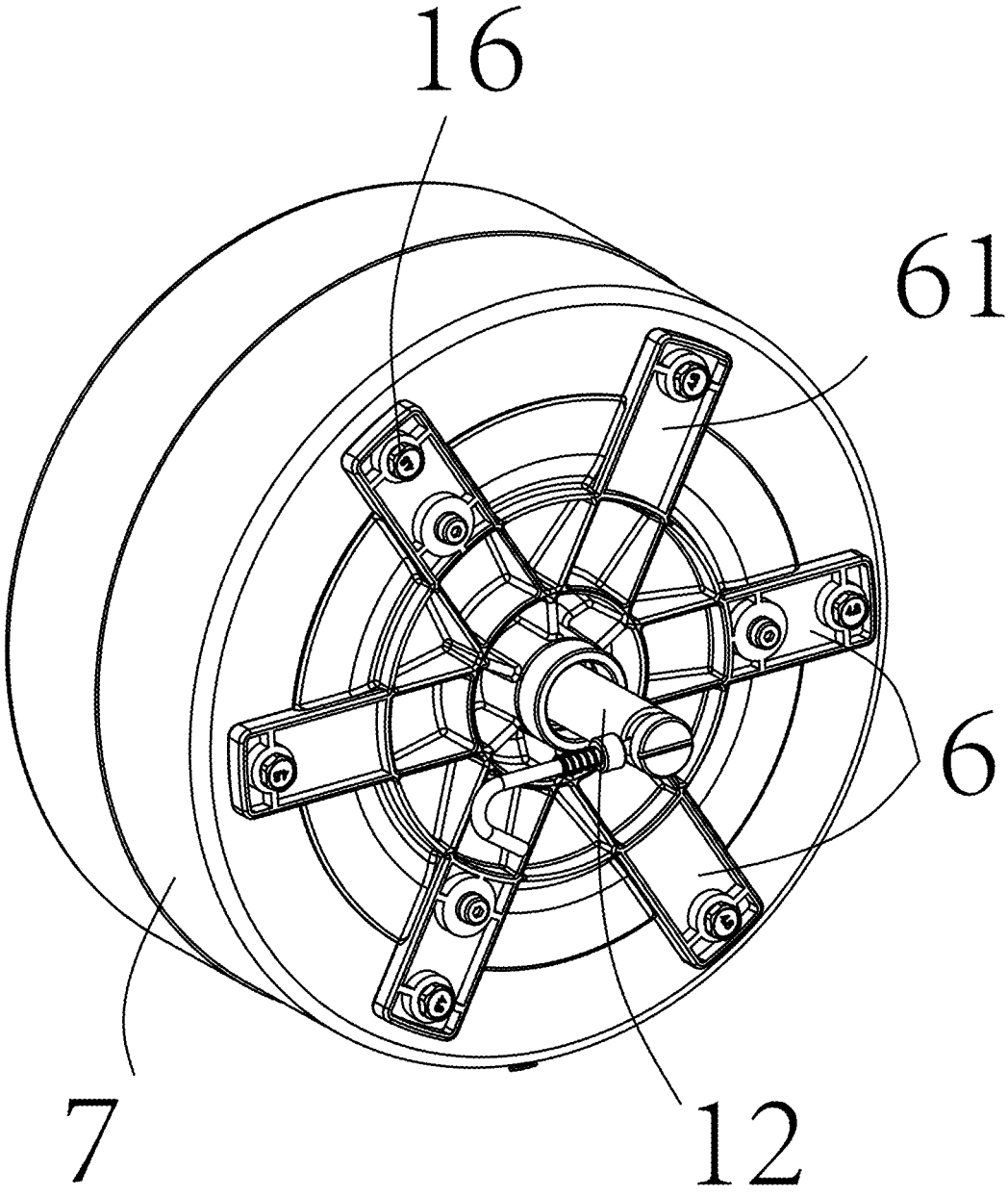
FIG. 4 is a schematic diagram of rotating parts of the drum dredging machine after removing components in FIG. 3.
Figure 5:
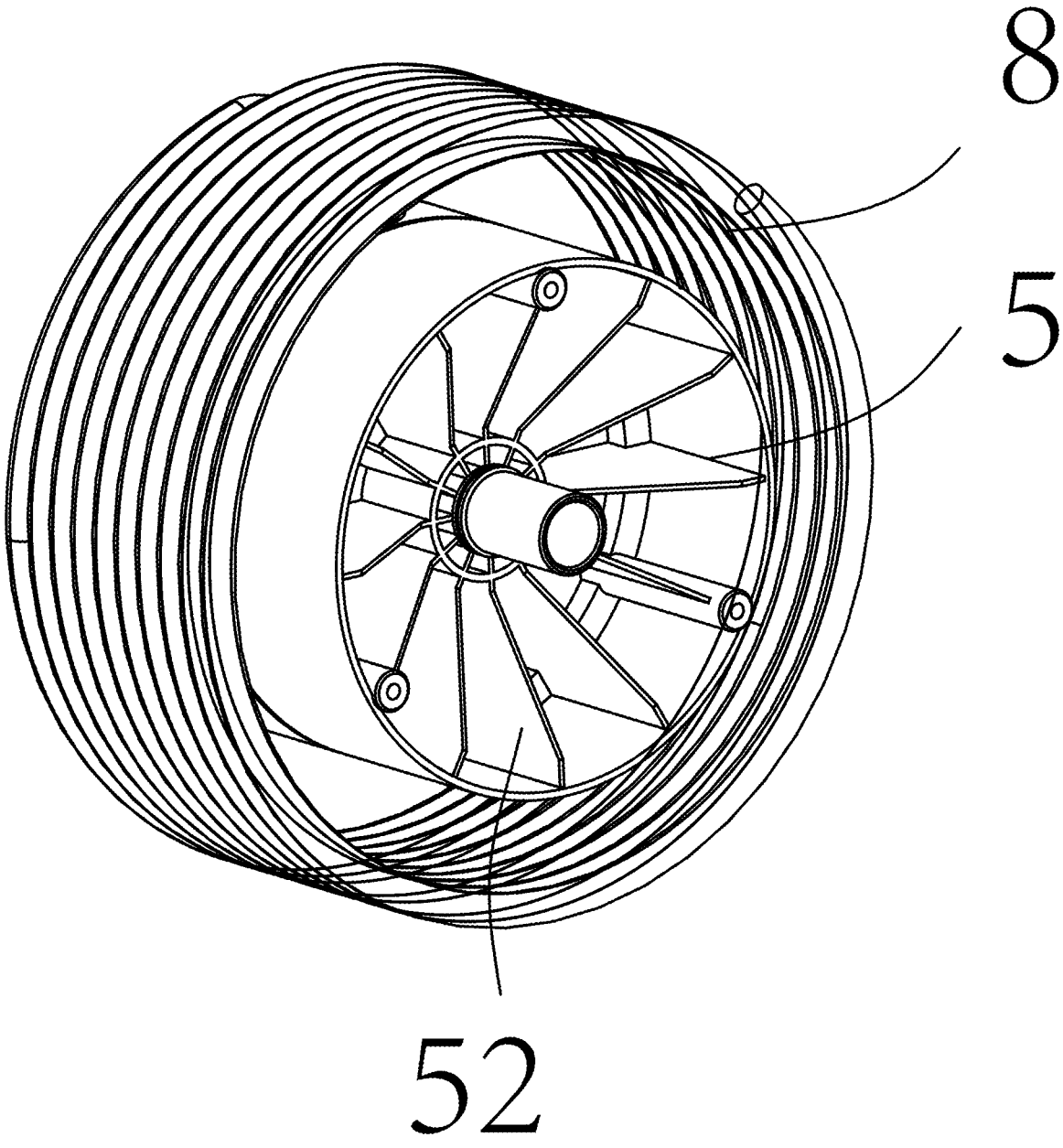
FIG. 5 is a schematic diagram of an inner lining and a flexible shaft.
Figure 6:
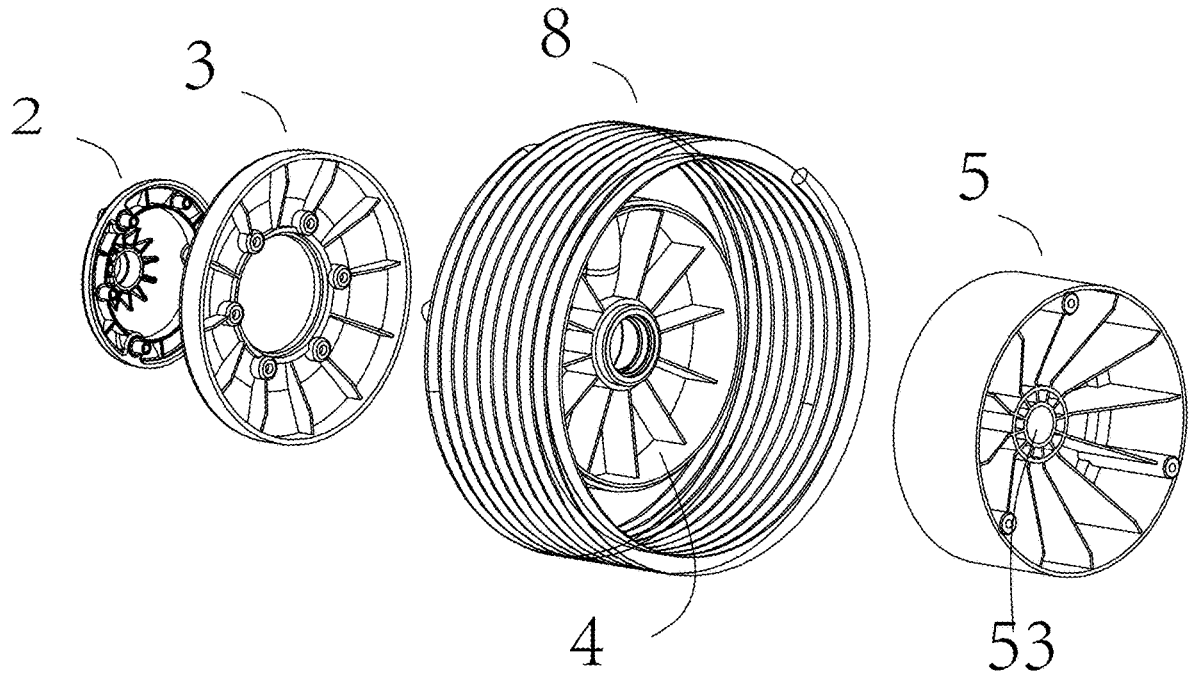
FIG. 6 is an exploded schematic diagram of components in FIG. 5.

As shown in FIG. 1, this embodiment discloses a drum dredging machine for preventing tangling, which includes a bracket 11 that supports the entire machine. The bracket 11 is provided with a motor 10 and a flexible shaft box 7. The motor 10 is provided above the flexible shaft box 7 and connected to the flexible shaft box 7 through a belt 101. The belt 101 is wrapped around a circumferential outer wall of the flexible shaft box 7, and when the motor 10 is rotated, the motor 10 drives the flexible shaft box 7 to rotate through the belt 101. An axial wall at a front end of the flexible shaft box 7 is provided with two hollow holes 71 that are penetrated inner and outer.

As shown in FIGS. 1 to 7 and 11, a fixing shaft 12 is fixedly provided on the bracket 11. A rod body of the bracket 11 is correspondingly provided with a locking hole 112 configured for the fixing shaft 12 to pass through. A locking pin 111 passes through a wall of the locking hole 112 and the fixing shaft 12 in a radial direction, so that circumferential and axial positions of the fixing shaft 12 are fixed, and the fixing shaft 12 cannot move in an axial direction or rotate in a circumferential direction. The fixing shaft 12 enters the flexible shaft box 7 and provides a rotational support for the flexible shaft box 7.

Two axial ends of the flexible shaft box 7 are provided with openings, a diameter of an opening at a front end of the flexible shaft box 7 is smaller than that of an opening at a rear end. Inside the flexible shaft box 7, a fixing sleeve 3, a rotatable sleeve 4, and an inner lining 5 are arranged in sequence from front to back. The fixing sleeve 3 is provided at a position close to the opening at the front end of the flexible shaft box 7, and the inner lining 5 is provided at a position near the opening at the rear end of the flexible shaft box 7. An interior of the inner lining 5 has divergent internal fixing plate 52 structures. A rear end of the inner lining 5 is provided with a fixing disk 6, and the fixing disk 6 has disk claws 61 that are evenly spaced along a circumferential direction of the fixing disk 6. The inner lining 5 and the fixing disk 6 are fixed by a bolt 16; the fixing disk 6 is located outside the opening at the rear end of the flexible shaft box 7. An outer diameter formed by the disk claws 61 of the fixing disk 6 is larger than a diameter of the opening at the rear end of the flexible shaft box 7. The disk claws 61 are also fixed to the flexible shaft box 7 by the bolt 16. The inner lining 5 is extended into an interior of the flexible shaft box 7 and is fixed to the flexible shaft box 7 through the fixing disk 6. There are 6-8 disk claws 61, which have mounting positions for fixing with the flexible shaft box 7 and the inner lining 5 through the bolt 16, thereby achieving a fixation of the disk claws 61 with the flexible shaft box 7 and the inner lining 5, respectively.

A shaft hole 53 is provided at axis of the inner lining 5 and the fixing disk 6 for the fixing shaft 12 to be extended into, and the shaft hole 53 runs through the axis of the inner lining 5 and the fixing disk 6 in an axial direction. An inner wall of the shaft hole 53 and an outer wall of the fixing shaft 12 are rotatably connected to the inner lining 5 and the fixing disk 6 through a fourth bearing 94. Due to the fixing disk 6 being fixed to the flexible shaft box 7, a rotational connection between the flexible shaft box 7 and the fixing shaft 12 is indirectly achieved, allowing the flexible shaft box 7 to be rotatably fixed on the bracket 11. In this embodiment, the fixing shaft 12 does not completely pass through the shaft hole 53 of the inner lining 5.

As shown in FIGS. 8, 9, 11, and 17, one end of the axial direction of the rotatable sleeve 4 is connected to the inner lining 5, and the inner lining 5 has a protruding portion 51 facing the rotatable sleeve 4. A second bearing 92 is provided on the protruding portion 51, and the rotatable sleeve 4 is sleeved on the protruding portion 51 and connected to the protruding portion 51 of the inner lining 5 through the second bearing 92, so that the rotatable sleeve 4 is rotatably fixed to the inner lining 5 and can be rotatably provided between the fixing sleeve 3 and the inner lining 5. A J-shaped guide groove 41 with a lateral opening is provided on the rotatable sleeve 4, and a front end of the guide groove 41 passes through the axis of the rotatable sleeve 4. A guide tube 1 is provided inside the guide groove 41, the guide tube 1 is hollow and arc-shaped, and a shape of the guide tube 1 is compatible with a shape of the guide groove 41.

Figure 7:
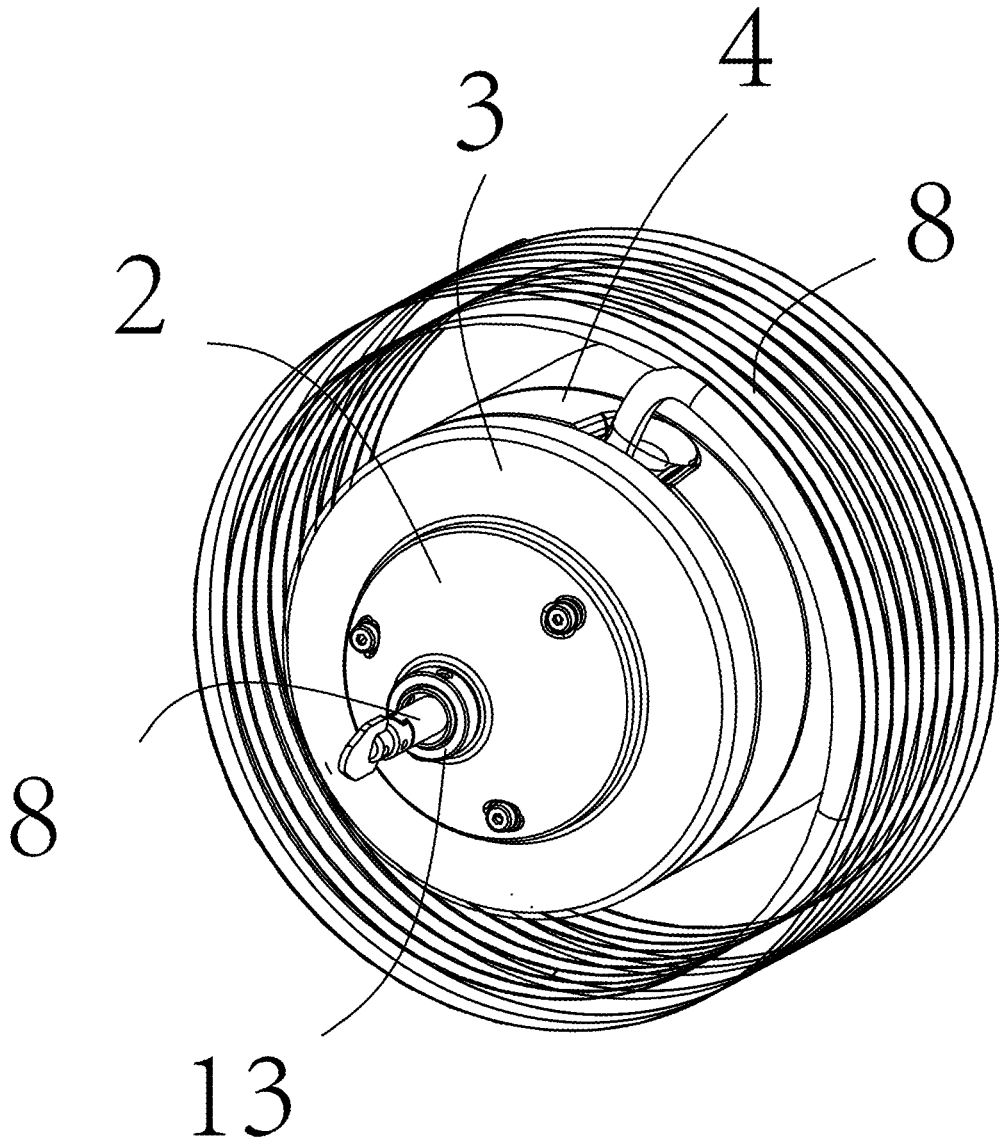
FIG. 7 is a schematic diagram of components of FIG. 4 with the flexible shaft in another angle.
Figure 8:
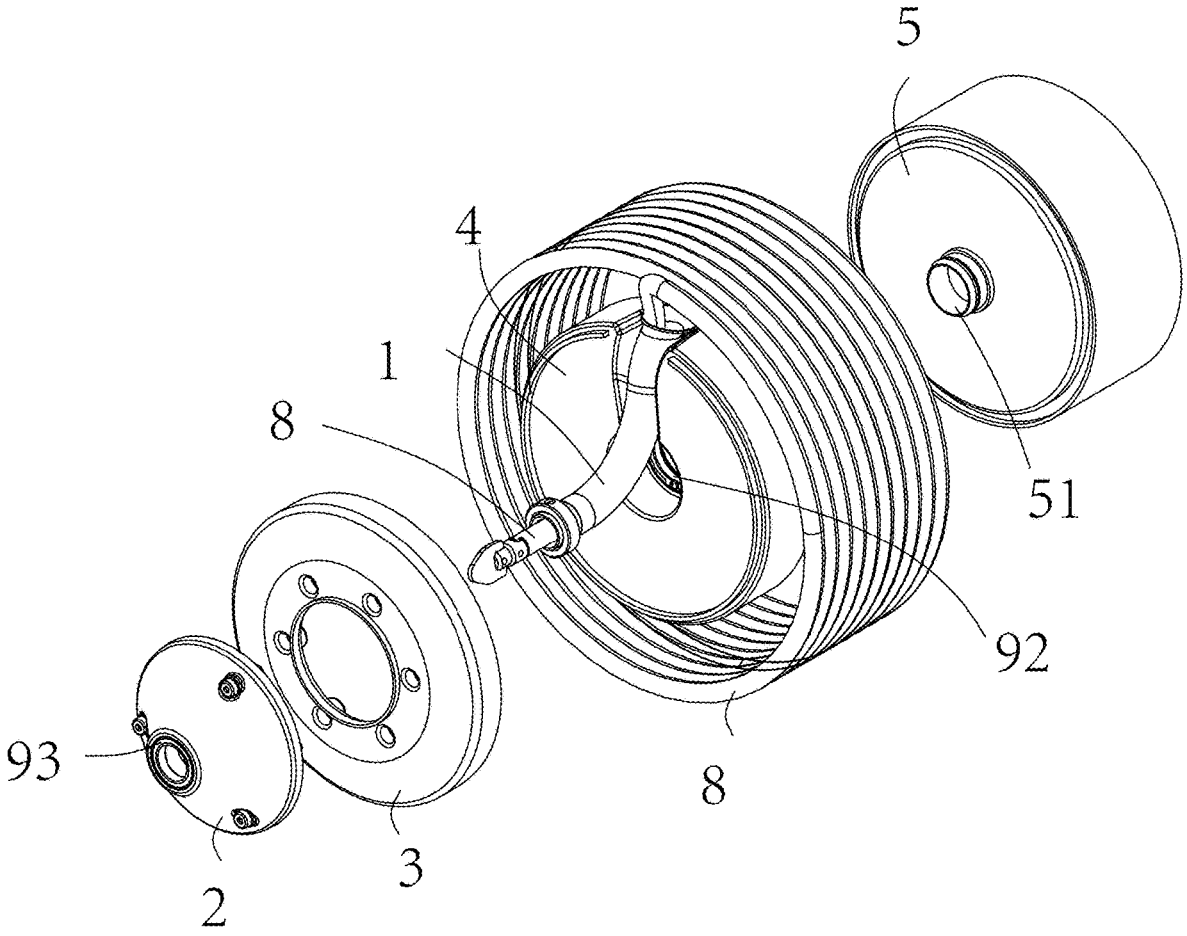
FIG. 8 is an exploded schematic diagram of FIG. 7.
Figure 9:
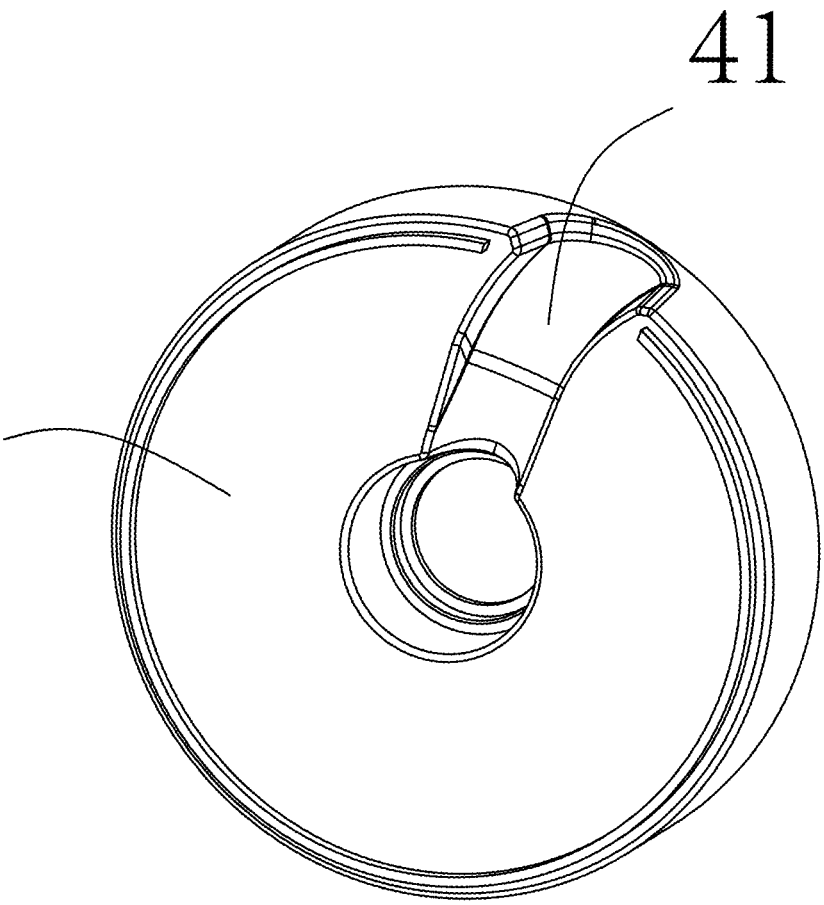
FIG. 9 is a schematic diagram of a rotatable sleeve.
Figure 10:
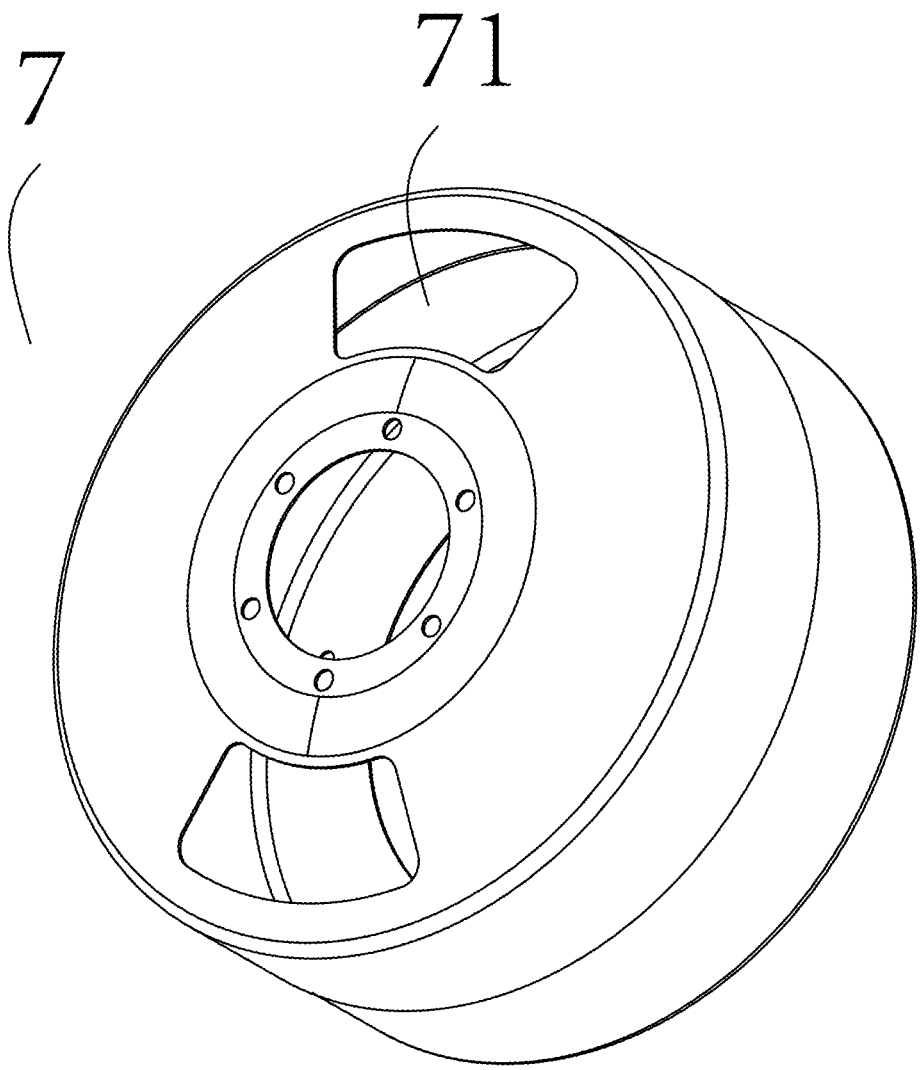
FIG. 10 is a schematic diagram of a flexible shaft box.
Figure 17:
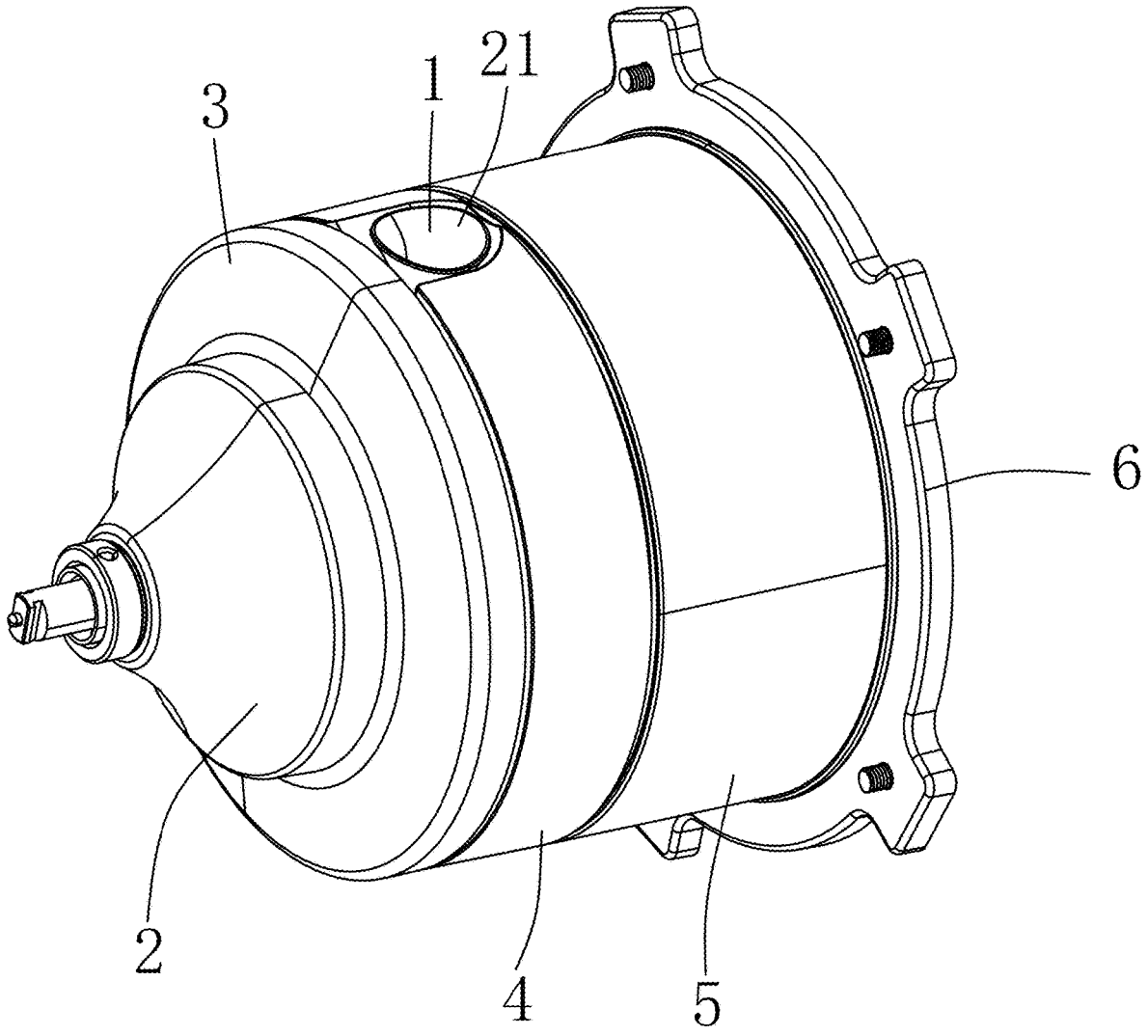
FIG. 17 is a schematic diagram of a fixing sleeve, an end cap, a rotatable sleeve, and an inner lining after removing the flexible shaft box.

As shown in FIGS. 7, 8, and 17, an outer side end of the guide tube 1 is extended to an outside of the flexible shaft box 7, and an inner side end of the guide tube 1 is a curved surface 21. The inner side end of the guide tube 1 is located inside the flexible shaft box 7 and at the opening of the guide groove 41, and is flush with a circumferential outer wall of the rotatable sleeve 4. In an implementation mode, the inner side end of the guide tube 1 can be completely retracted into the guide groove 41, that is, the inner side end of the guide tube 1 is lower than the circumferential outer wall of the rotatable sleeve 4.

As shown in FIGS. 8, 9, 11, 16, and 17, a hollow end cap 2 is fixedly provided on the fixing sleeve 3. The end cap 2 is a conical structure with flat top and bottom, and an interior of the end cap 2 is hollow. A front section of the guide tube 1 passes through the fixing sleeve 3 and the end cap 2. The end cap 2 is fixed on the outside of the flexible shaft box 7, and the end cap 2 is coaxially arranged with the fixing sleeve 3. A wall of an end face of the flexible shaft box 7 is located between the end cap 2 and the fixing sleeve 3. The end cap 2, the wall of the end face of the flexible shaft box 7, and the fixing sleeve 3 are all provided with screw holes. A bolt 16 can pass through the screw holes of the three to fix them together, or welding can be used to achieve a fixation of the three. The end cap 2 is connected to the guide tube 1 through a third bearing 93, thereby achieving a rotational connection between the guide tube 1 and the flexible shaft box 7.

Figure 11:
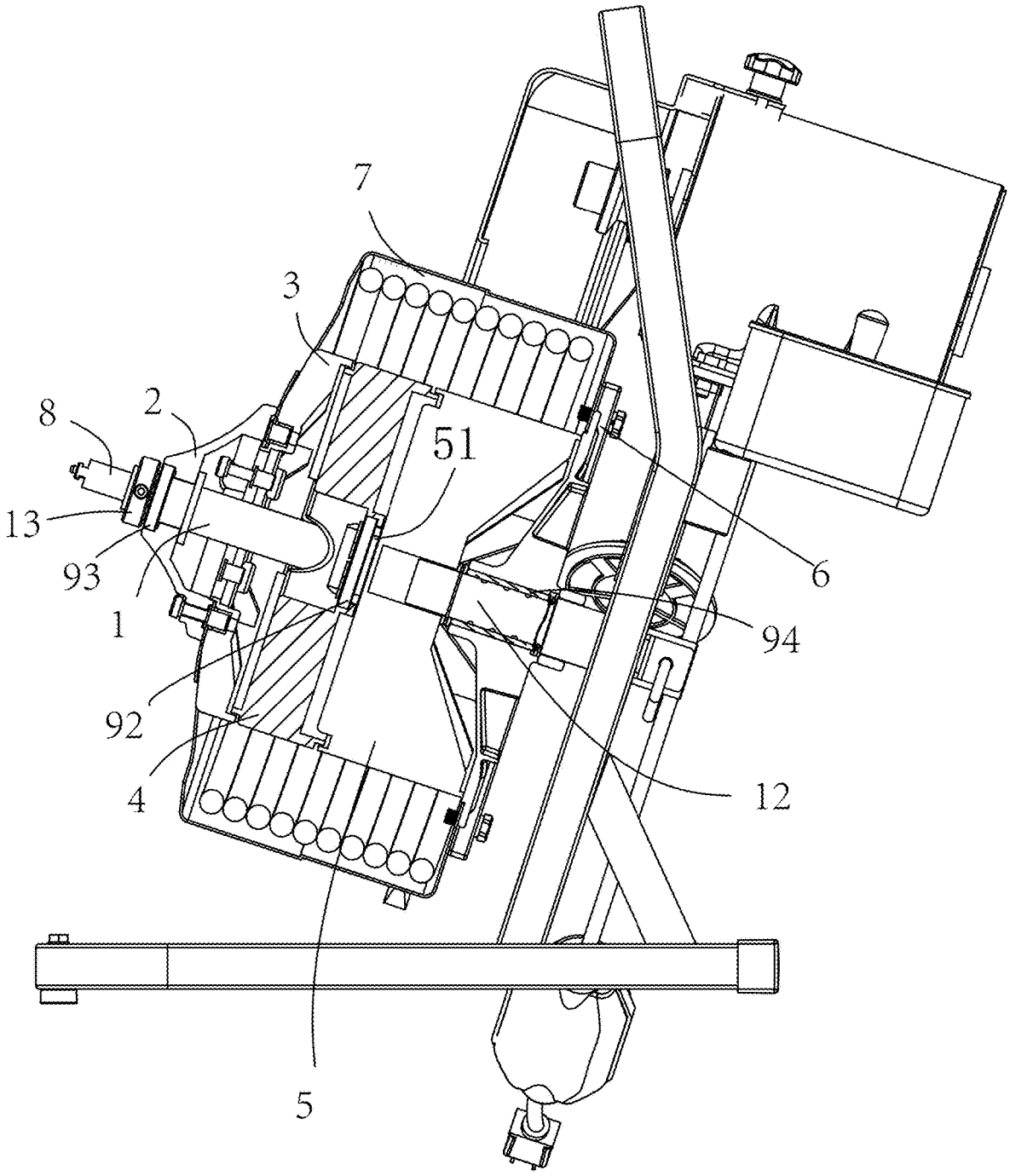
FIG. 11 is a schematic diagram of an internal sectional state.
Figure 16:
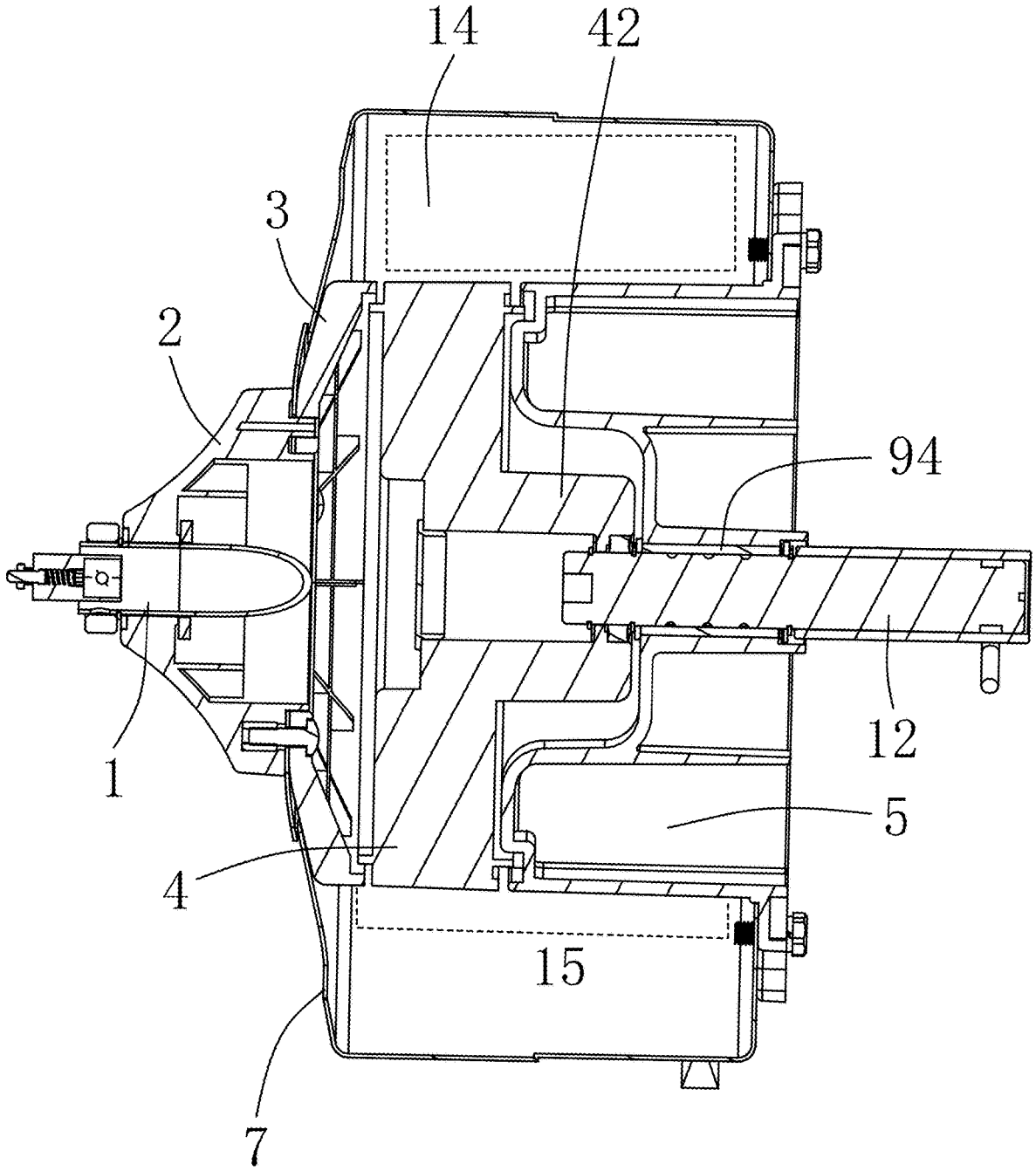
FIG. 16 is a sectional view of the flexible shaft box after removing the flexible shaft.

As shown in FIGS. 11, 16, and 17, a flexible shaft 8 is provided inside the flexible shaft box 7. The fixing sleeve 3, the inner lining 5, and the rotatable sleeve 4 are coaxially arranged, the three fill and define an axial space inside the flexible shaft box 7. The circumferential outer walls of the fixing sleeve 3, the inner lining 5, and the rotatable sleeve 4 are aligned in the axial direction, so that an annular outer wall 15 formed by the three together forms a complete annular chamber 14 with an inner wall of the flexible shaft box 7 for winding and storing the flexible shaft 8. One end of the flexible shaft 8 is fixed to the flexible shaft box 7 or the inner lining 5, and the other end thereof passes through the guide tube 1 and is exposed on the outside of the flexible shaft box 7. When the flexible shaft box 7 is rotated in forward or reverse direction, the flexible shaft 8 will enter and exit from the guide tube 1.

Figure 18:
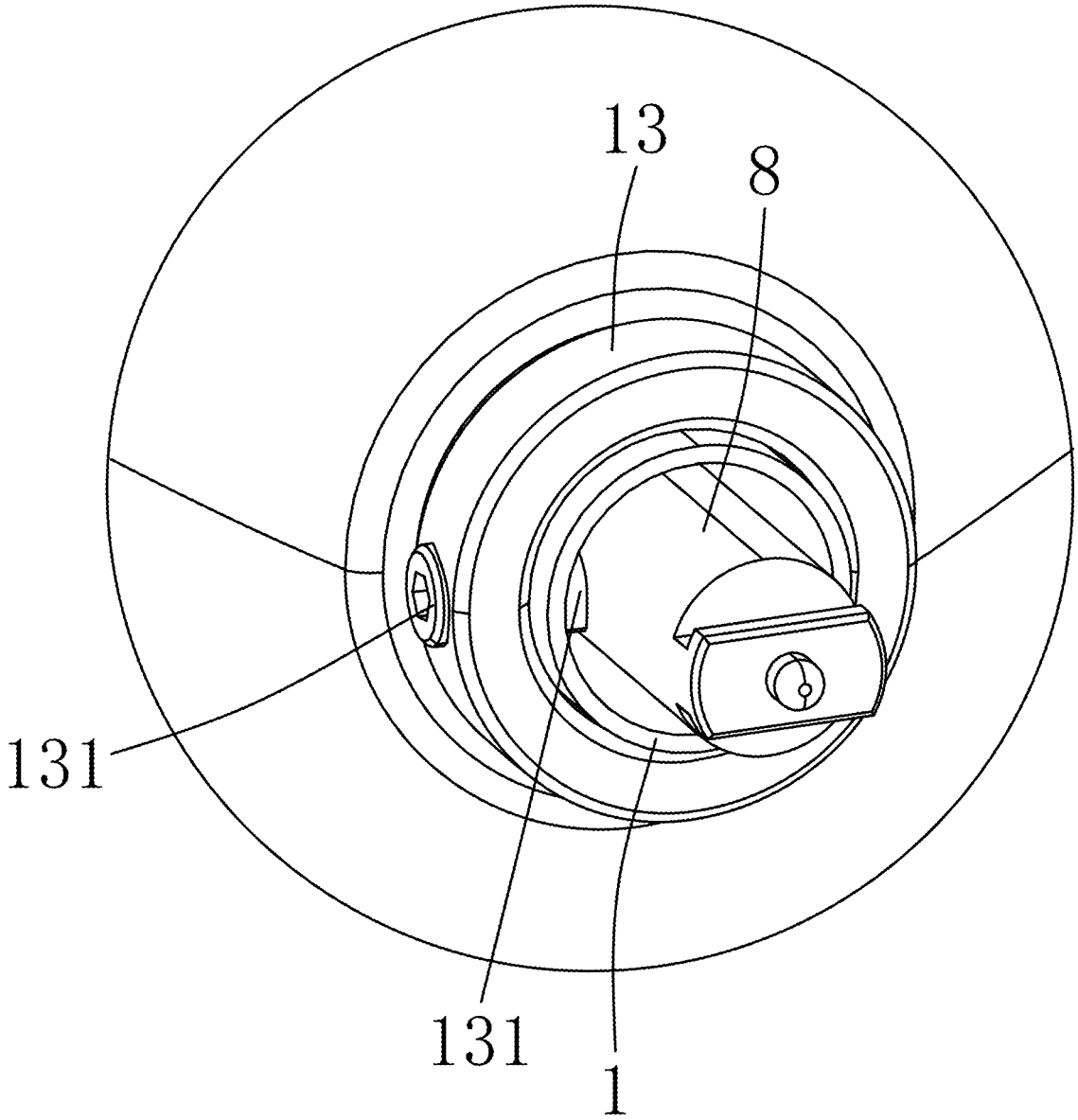
FIG. 18 is an enlarged view of a fixing ring.

As shown in FIG. 18, an outer side end of the guide tube 1 that is exposed from the end cap 2 is sleeved with a fixing ring 13, and a fixing pin 131 passes through the fixing ring 13 and the wall of the guide tube 1 to compress the flexible shaft 8 inside the guide tube 1. The fixing pin 131 can also be replaced with the bolt.

Figure 12:
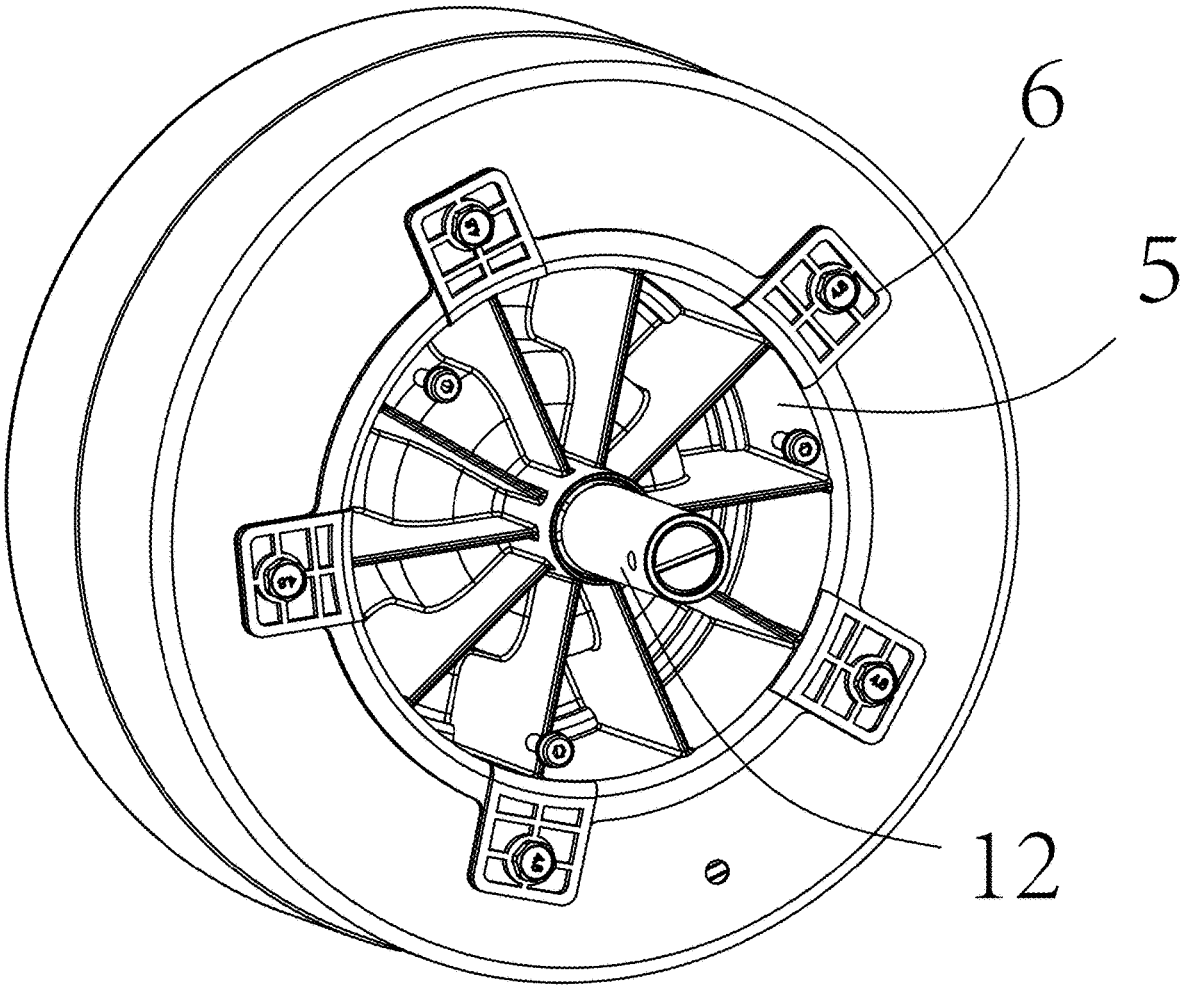
FIG. 12 is a schematic diagram of the inner lining installed on the flexible shaft box in an embodiment.
Figure 13:
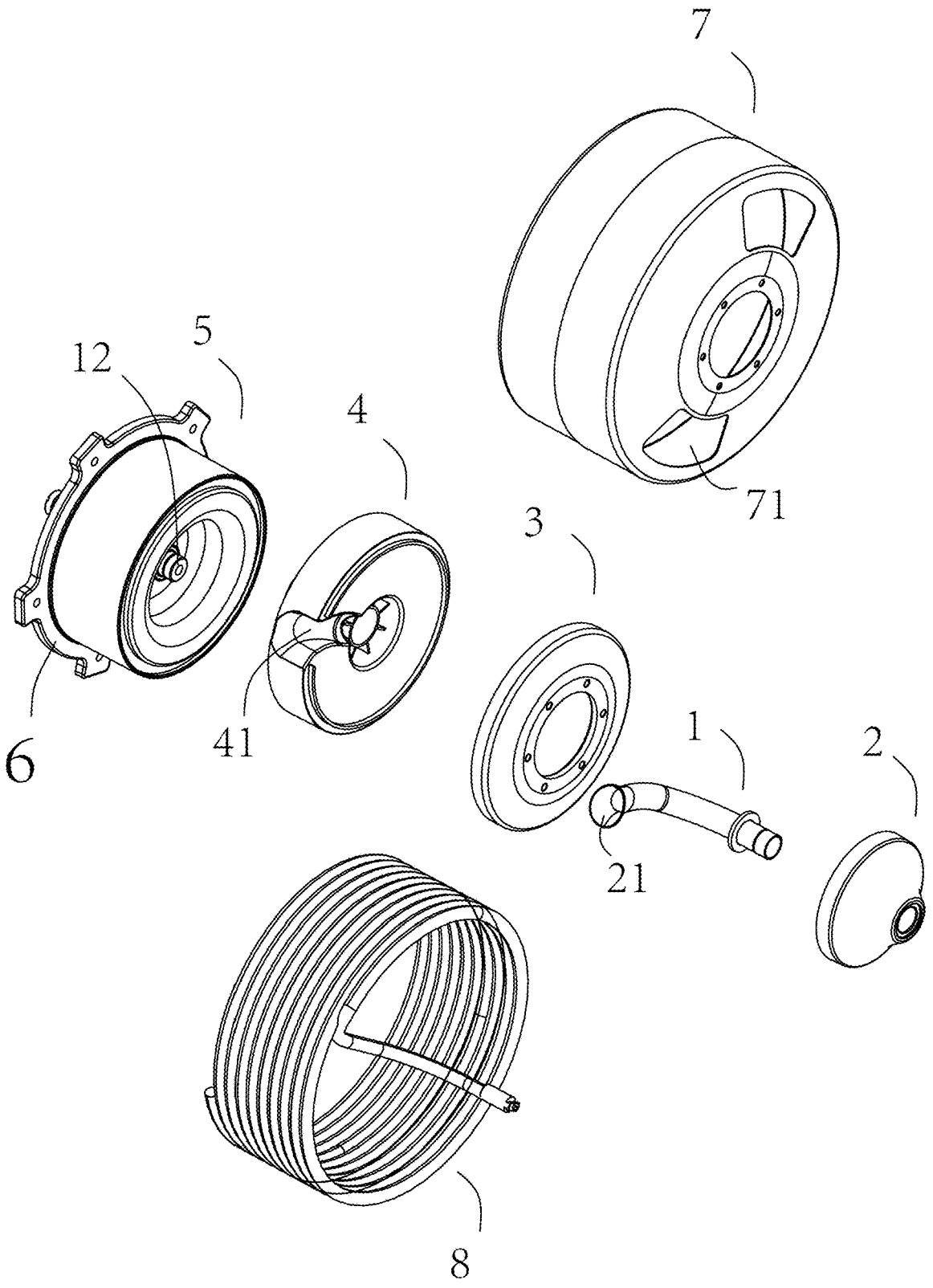
FIG. 13 is an exploded schematic diagram of the flexible shaft box in an embodiment.
Figure 14:
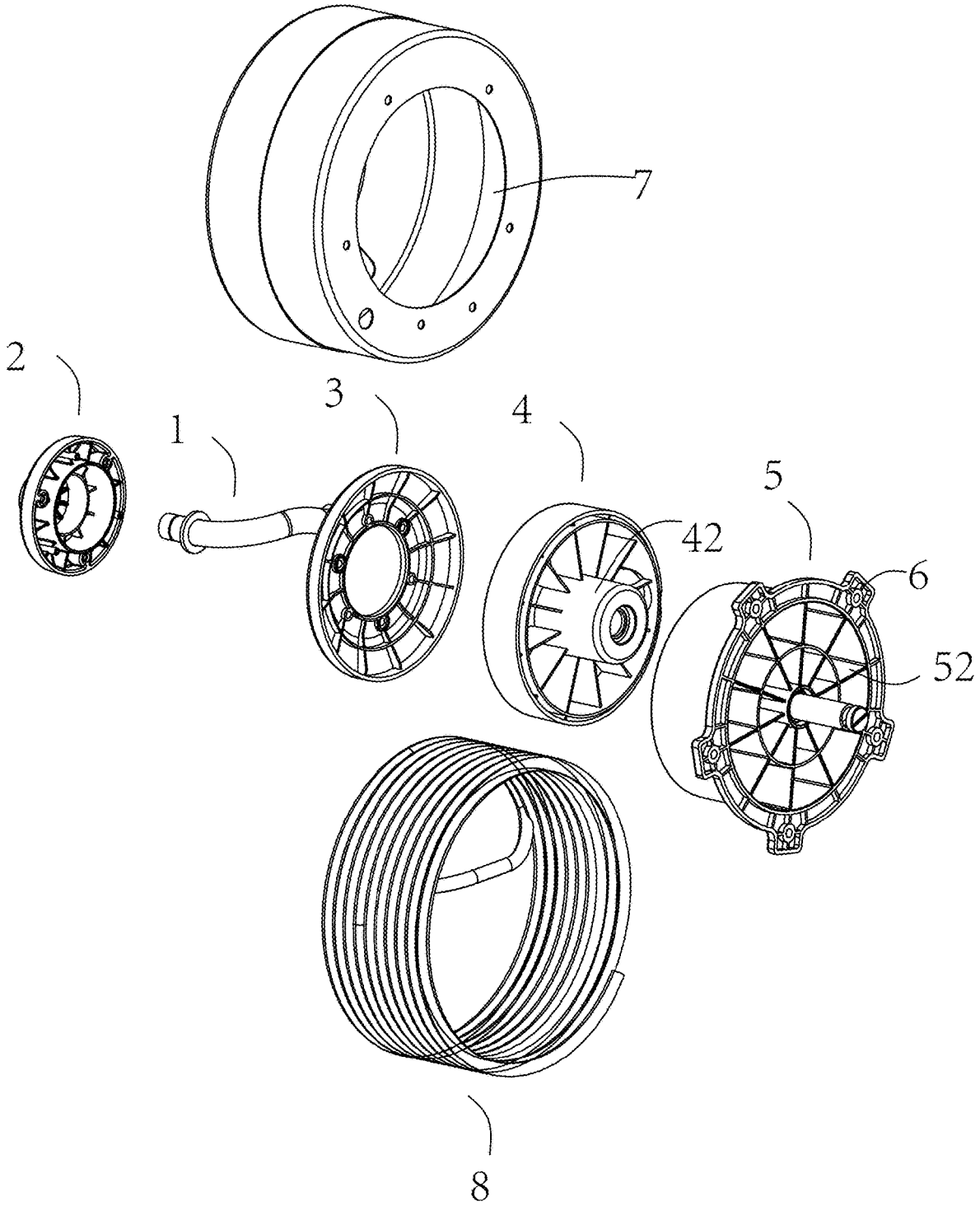
FIG. 14 is an exploded schematic diagram of FIG. 13 from another perspective.
Figure 15:
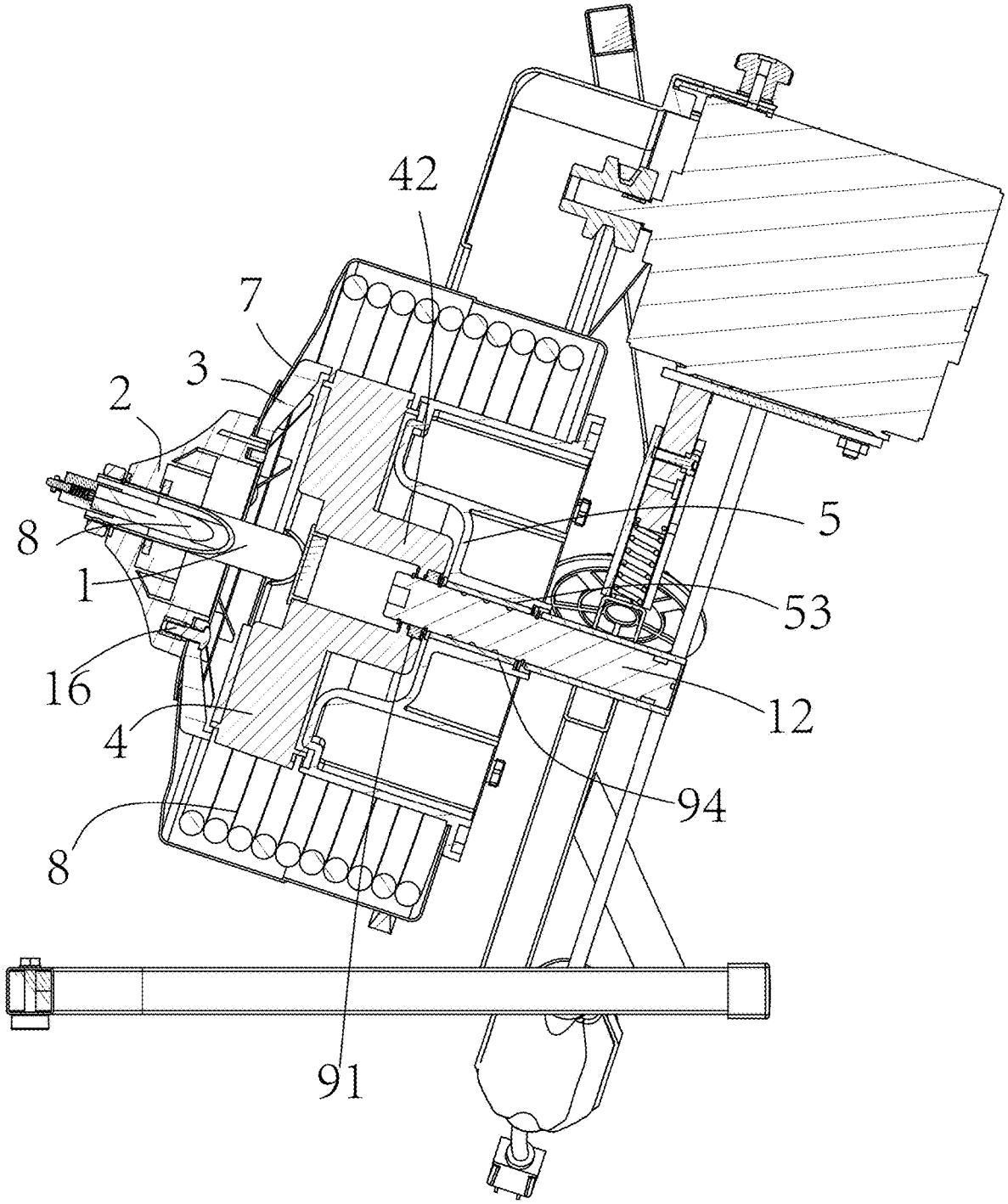
FIG. 15 is a sectional view of another embodiment.

As shown in FIGS. 12 to 14, the fixing disk 6 and the inner lining 5 are integrally formed. One end of the rotatable sleeve 4 facing the inner lining 5 is provided with an extension portion 42 that is inwardly extended towards the inner lining 5. One end of the inner lining 5 facing the rotatable sleeve 4 is concave inward to form a recess, and the recess corresponds to a shape of the extension portion 42 of the rotatable sleeve 4. The fixing shaft 12 passes through the shaft hole 53, so that the extension portion 42 of the rotatable sleeve 4 can be sleeved on the fixing shaft 12; the extension portion 42 is connected to the fixing shaft 12 through a first bearing 91, thereby enabling the rotatable sleeve 4 to be rotatably fixed on the fixing shaft 12.

When in use, the motor 10 drives the flexible shaft box 7 to rotate, and at the same time the flexible shaft 8 is driven to rotate. A rotation of the flexible shaft 8 will drive the guide tube 1 to rotate. The guide tube 1 is linked with the rotatable sleeve 4, the rotatable sleeve 4 is caused to rotate. The rotatable sleeve 4 simulates rotation states of the guide tube 1 and the flexible shaft 8 so as to maintain synchronous rotation with the flexible shaft 8. The flexible shaft 8 enters and exits on the guide tube 1, and the guide tube 1 sorts out the winding or loosening of the flexible shaft 8. At the same time, the flexible shaft 8 enters and exits the guide tube 1 to clean a sewer pipe. When the flexible shaft 8 needs to be wrapped and stored, the integrity of the annular chamber 14 can provide circumferential and radial constraints on the flexible shaft 8 during winding. Besides that, the rotatable sleeve 4 and the guide tube 1 can be used to comb the flexible shaft 8, thereby reducing the possibility of tangling.

What is claimed is:

1. A drum dredging machine for preventing tangling, comprising:

a flexible shaft box, an interior of the flexible shaft box is hollow, and a flexible shaft is wrapped and stored inside the flexible shaft box;

a guide tube, which is provided inside the flexible shaft box and is rotatably connected to the flexible shaft box; the guide tube is arc-shaped, and one end of the guide tube is extended to an outer side of the flexible shaft box, the guide tube is hollow, and the flexible shaft is inserted and exited through the guide tube;

a fixing sleeve, which is fixedly provided at an axial end of the flexible shaft box, the fixing sleeve is hollow and is configured for the guide tube to be extended outside the flexible shaft box;

an inner lining, which is fixedly provided at another axial end of the flexible shaft box;

a rotatable sleeve, which is rotatably provided between the fixing sleeve and the inner lining, and the rotatable sleeve is connected to an axis side of the inner lining; the rotatable sleeve is provided with a guide groove that matches a shape of the guide tube, and the guide tube is placed in the guide groove to cause the guide tube to be in contact with the rotatable sleeve;

wherein the fixing sleeve, the inner lining, and the rotatable sleeve are coaxially arranged, and the fixing sleeve, the inner lining, and the rotatable sleeve define an axial space inside the flexible shaft box, so that an annular outer wall forme by the fixing sleeve, the inner lining, and the rotatable sleeve forms an annular chamber with an inner wall of the flexible shaft box, wherein the annular chamber is configured for the flexible shaft to be wound and stored.

2. The drum dredging machine for preventing tangling according to claim 1, wherein circumferential outer walls of the fixing sleeve, the inner lining, and the rotatable sleeve are aligned in an axial direction.

3. The drum dredging machine for preventing tangling according to claim 2, wherein an inner side end of the guide tube is located at an opening of the guide groove and is flushed with the circumferential outer wall of the rotatable sleeve; or the inner side end of the guide tube is located inside the guide groove.

4. The drum dredging machine for preventing tangling according to claim 1, wherein the drum dredging machine further comprises a bracket and a fixing shaft fixedly provided on the bracket, the fixing shaft passes through an axis of the flexible shaft box and the inner lining, the flexible shaft box and the inner lining are rotatably fixed on the fixing shaft;

the rotatable sleeve comprises an extension portion that is outwardly protruded towards the inner lining, the extension portion is sleeved on the fixing shaft and connected to the fixing shaft through a first bearing, thereby enabling the rotatable sleeve to be rotatably provided between the fixing sleeve and the inner lining.

5. The drum dredging machine for preventing tangling according to claim 4, wherein one end of the inner lining facing the rotatable sleeve is inwardly recessed to form a recess, and the recess corresponds to a shape of the extension portion of the rotatable sleeve, the inner lining is provided with a shaft hole that is penetrated axially, the shaft hole passes through a center of the recess, and the fixing shaft passes through the shaft hole.

6. The drum dredging machine for preventing tangling according to claim 1, wherein the drum dredging machine further comprises a bracket and a fixing shaft fixedly provided on the bracket, the fixing shaft passes through an axis of the flexible shaft box and the inner lining, the flexible shaft box and the inner lining are rotatably fixed on the fixing shaft;

the inner lining comprises a protruding portion facing the rotatable sleeve, the protruding portion is provided with a second bearing, and the rotatable sleeve is sleeved on the second bearing; so that the rotatable sleeve is rotatably connected to the protruding portion of the inner lining, thereby enabling the rotatable sleeve to be rotatably provided between the fixing sleeve and the inner lining.

7. The drum dredging machine for preventing tangling according to claim 1, wherein a hollow end cap is fixedly provided on the fixing sleeve, and the guide tube passes through the fixing sleeve and the end cap;

the end cap is axially connected to the guide tube through a third bearing, thereby enabling a rotational connection between the guide tube and the flexible shaft box.

8. The drum dredging machine for preventing tangling according to claim 7, wherein the end cap is fixedly provided on an outer side of the flexible shaft box, the end cap is coaxially arranged with the fixing sleeve, a wall of an end face of the flexible shaft box is located between the end cap and the fixing sleeve;

the end cap, the wall of the end face of the flexible shaft box, and the fixing sleeve are all provided with screw holes, the end cap, the flexible shaft box and the fixing sleeved are fixed together by a bolt passing through the screw holes.

9. The drum dredging machine for preventing tangling according to claim 7, wherein the end cap is a conical structure with upper and lower flat tops, and an interior of the end cap is hollow.

10. The drum dredging machine for preventing tangling according to claim 8, wherein a fixing ring is fixedly sleeved on an outer side end of the guide tube, and the fixing ring is located on an outer side of the end cap of the guide tube;

the bolt or a fixing pin passes through the fixing ring and the wall of the guide tube, and compresses the flexible shaft in the guide tube.

11. The drum dredging machine for preventing tangling according to claim 1, wherein an axial wall of the flexible shaft box is provided with a plurality of hollow holes that are penetrated inside and outside.

12. The drum dredging machine for preventing tangling according to claim 1, wherein the inner lining comprises a fixing disk provided at an end of the inner lining, the inner lining is fixedly connected or integrally formed with the fixing disk, an outer diameter of the fixing disk is larger than an outer diameter of the inner lining, the fixing disk is located on an outer side of the flexible shaft box and fixed to the axial end face of the flexible shaft box by the bolt.

13. The drum dredging machine for preventing tangling according to claim 1, wherein an interior of the inner lining comprises internal fixing plate structures.

* * * * *